US007930985B2

(12) United States Patent
Walworth et al.

(10) Patent No.: US 7,930,985 B2
(45) Date of Patent: Apr. 26, 2011

(54) SPORTS BOARD

(76) Inventors: Christopher J. Walworth, Costa Mesa, CA (US); Cari M. Walworth, Costa Mesa, CA (US)

( * ) Notice: Subject to any disclaimer, the term of this patent is extended or adjusted under 35 U.S.C. 154(b) by 75 days.

(21) Appl. No.: 12/337,993

(22) Filed: Dec. 18, 2008

(65) Prior Publication Data

US 2009/0165690 A1 Jul. 2, 2009

Related U.S. Application Data

(60) Provisional application No. 61/018,631, filed on Jan. 2, 2008.

(51) Int. Cl.
*B63B 35/73* (2006.01)

(52) U.S. Cl. ..... 114/55.58

(58) Field of Classification Search ..... 114/55.5, 114/55, 58; 440/38; 441/74
See application file for complete search history.

(56) References Cited

U.S. PATENT DOCUMENTS

| | | | | |
|---|---|---|---|---|
| 3,324,822 | A * | 6/1967 | Carter, III | 440/38 |
| 4,857,025 | A * | 8/1989 | Brown et al. | 441/65 |
| 4,971,586 | A * | 11/1990 | Walsh | 440/88 R |
| 5,582,529 | A * | 12/1996 | Montgomery | 441/74 |
| 5,796,183 | A * | 8/1998 | Hourmand | 307/116 |
| 5,947,788 | A * | 9/1999 | Derrah | 446/154 |
| 6,192,817 | B1 * | 2/2001 | Dec et al. | 114/55.56 |
| 6,409,560 | B1 * | 6/2002 | Austin | 441/74 |
| 6,568,340 | B2 * | 5/2003 | Dec et al. | 114/55.56 |
| 7,705,748 | B2 * | 4/2010 | Fu | 340/903 |
| 2008/0089786 | A1 * | 4/2008 | Sinreich | 416/129 |

* cited by examiner

*Primary Examiner* — Daniel V Venne

(57) ABSTRACT

A sports apparatus configured to support a rider upon the water surface is disclosed and may comprise either a compartment in the top surface configured to accept personal articles and a watertight cover to prevent damage and loss of personal articles or a propulsion source. The sports apparatus can have a V-shaped hull to add stability when used in the waves. The propulsion source is powered by either a combustion or electric motor that is controlled by a user interface on the board.

22 Claims, 18 Drawing Sheets

| FIG. 15A | FIG. 15B |
|---|---|

SPORTS BOARD

CROSS REFERENCE TO RELATED APPLICATIONS

This application claims priority to U.S. Provisional No. 61/018,631 filed on Jan. 2, 2008, the contents of which are incorporated in their entirety.

BACKGROUND OF THE INVENTION

There are several types of sports boards for water sport activities on the market, such as a skimboard, a surfboard and body board. The skimboard is used for gliding on the water close to the beach. The surfboard can be used for riding upon waves while standing. Similar in design to that of the surfboard has been the development of the body board that has attributes of both a skimboard and a surfboard. The body board can be described as a shorter version of the surfboard that can support a rider who is lying on the board in a prone position, rather than be required to be standing upright with a surfboard.

BRIEF SUMMARY OF THE INVENTION

A first embodiment disclosed is a motorized buoyant sports apparatus comprising a body having a top surface configured to support the rider; a propulsion source attached to said body; a controller on said body connected to the propulsion source; and a power source attached to the body and connected to the propulsion source.

A second embodiment disclosed is a sports apparatus comprising: a top surface configured to support a rider, the top surface having a front portion and a rear portion; a bottom surface having a central protrusion that extends from the front portion to the rear portion; a compartment in the top surface configured to store articles; and a watertight cover to prevent damage and loss of the articles.

A third embodiment disclosed is a motorized buoyant sports apparatus comprising: a top surface configured to support a rider, the top surface having a front portion and a rear portion; a first edge terminated by a first grip projection in the front portion; a second edge terminated by a second grip projection in the front portion; a first triangular shaped protrusion in the rear portion of the top surface; a second triangle shaped protrusion in the rear portion of the top surface; a central triangular projection on the top surface positioned between the first and the second grip projection; a bottom surface having a central protrusion that extends from the front portion to the rear portion; a first outrigger edge on the bottom surface; a second outrigger edge on the bottom surface; a first channel formed between the first outrigger edge and the central protrusion; a second channel formed between the second outrigger edge and the central protrusion; a propulsion source having a throttle; a frame attached to the bottom surface, wherein the propulsion source is attached to the frame; a compartment in the top surface configured to accept personal articles and allow access to the propulsion source; a watertight cover to prevent damage to propulsion system and loss of personal articles; a touch pad on the top surface connected to the throttle; and a power source connected to the propulsion source.

BRIEF DESCRIPTION OF THE DRAWINGS

Some embodiments of this invention will be described in detail, with reference to the following figures, wherein like designations denote like members. The following embodiments disclosed herein are just several possible illustrations of the disclosed invention and is not intended to be limiting.

DETAILED DESCRIPTION OF THE INVENTION

Figure 1:
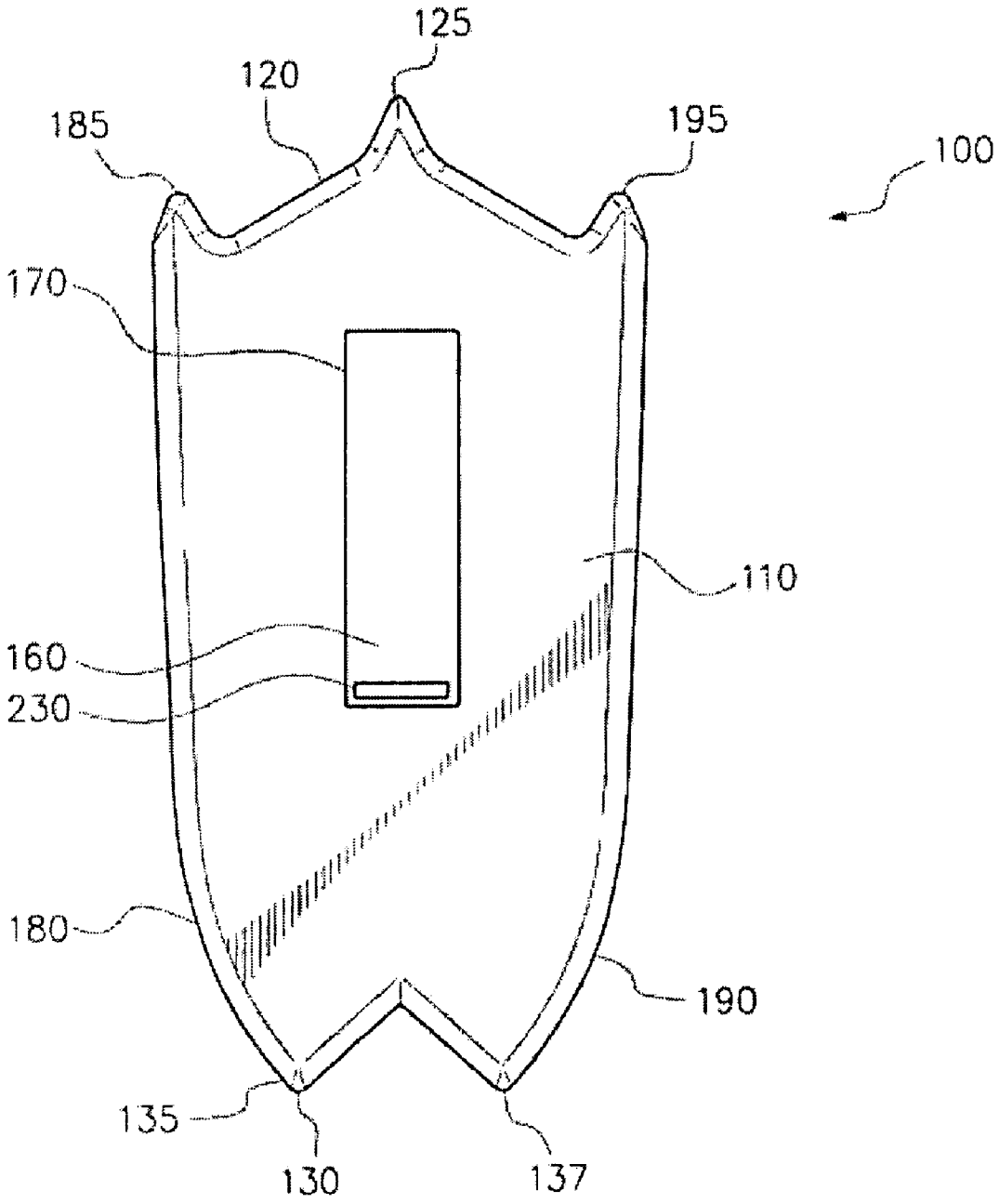
FIG. 1 shows a top view of an embodiment of the apparatus.

Although certain embodiments of the present invention will be shown and described in detail, it should be understood that various changes and modifications may be made without departing from the scope of the appended claims. Components gearing, pulleys, chain driven mechanism, transmission, offset motor, and combustion engine, which are not shown in the drawing, are conventional and are known in the art.

As a preface to the detailed description, it should be noted that, as used in this specification and the appended claims, the singular forms “a”, “an” and “the” include plural referents, unless the context clearly dictates otherwise.

The sports board disclosed herein can be configured as a skim board, surf board, body board, kick board or any other buoyant surface apparatus that can be mounted either in a prone or standing position during use in water bodies for purpose of recreation. The sports board can be buoyant enough to support the intended rider, which may weigh from 30 to 300 lbs, upon or near to the surface of the water. The buoyancy of an object is determined by the weight of the water that is displaced when the object is submerged. Hollow objects can be heavy and still remain buoyant if the interior remains free of water and could be used to form the body. Materials that can be also be used to produce the body are those that naturally float because of lower specific gravity without depending on just displacement. Such materials are either natural such as light density celluosic matter, for example balsa wood, cork, etc or man-made materials such as plastics, specifically foamed plastics.

Figure 3:
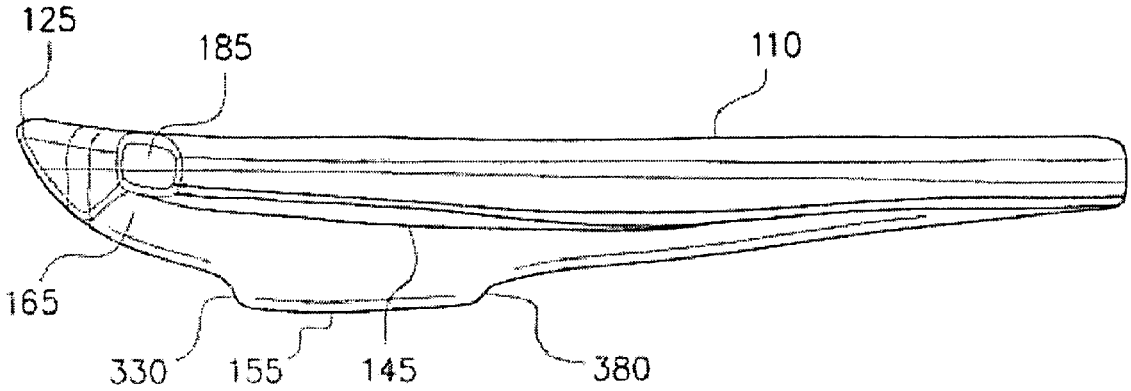
FIG. 3 illustrates a side view of an embodiment of the apparatus.
Figure 4:
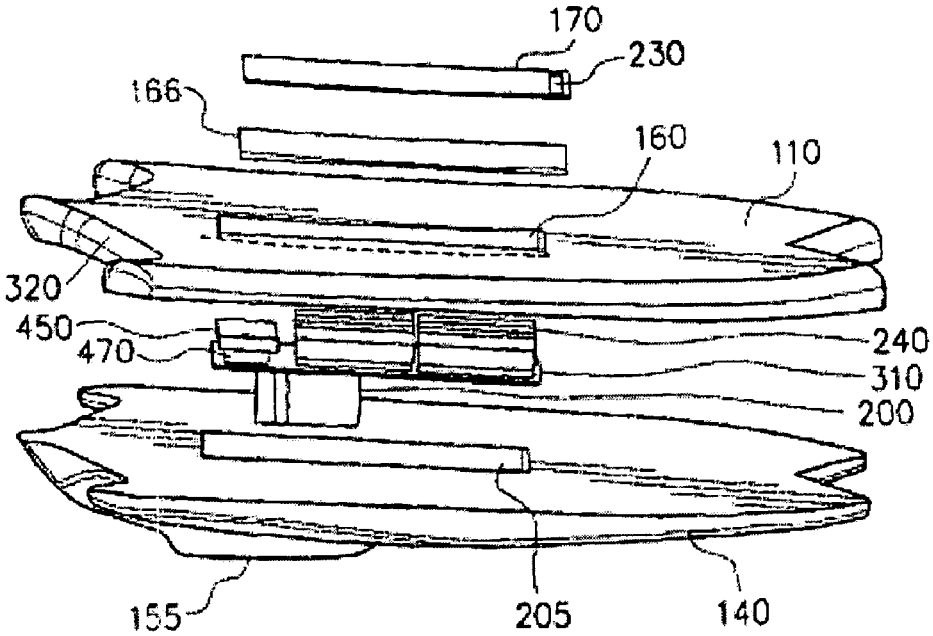
FIG. 4 illustrates a side exploded view of an embodiment of the apparatus.

The sports board 100 can be made of a plastic material that can be made to be even more buoyant by the introduction of trapped gas bubbles that will not have the ability to absorb water, i.e. a closed cell structure. The plastic material can either be a thermoplastic or a thermoset material and could be foamed by the injection of gasses or through a reaction of components that form the polymer background that when cured or cool are sufficiently rigid to support the rider while in the water. For example, a mold of the negative of the sports board can be filled with an olefin, such as polypropylene, that is injected with a gas to form a closed cell material that cools into the body of the sports board 100. The sports board can be formed in a single molding operation as shown in FIG. 3 or produced in sections that can be glued or secured together from multiple sections such as shown in FIG. 4. When formed by sections the top surface 110 may be formed from a material that is partially compressible under body weight for increased comfort of the rider with the lower section or lower surface 140 sufficiently rigid enough to support the body weight of the rider without significant deflection, defined as more than 1-5% change in dimension when ridden in water.

Figure 2:
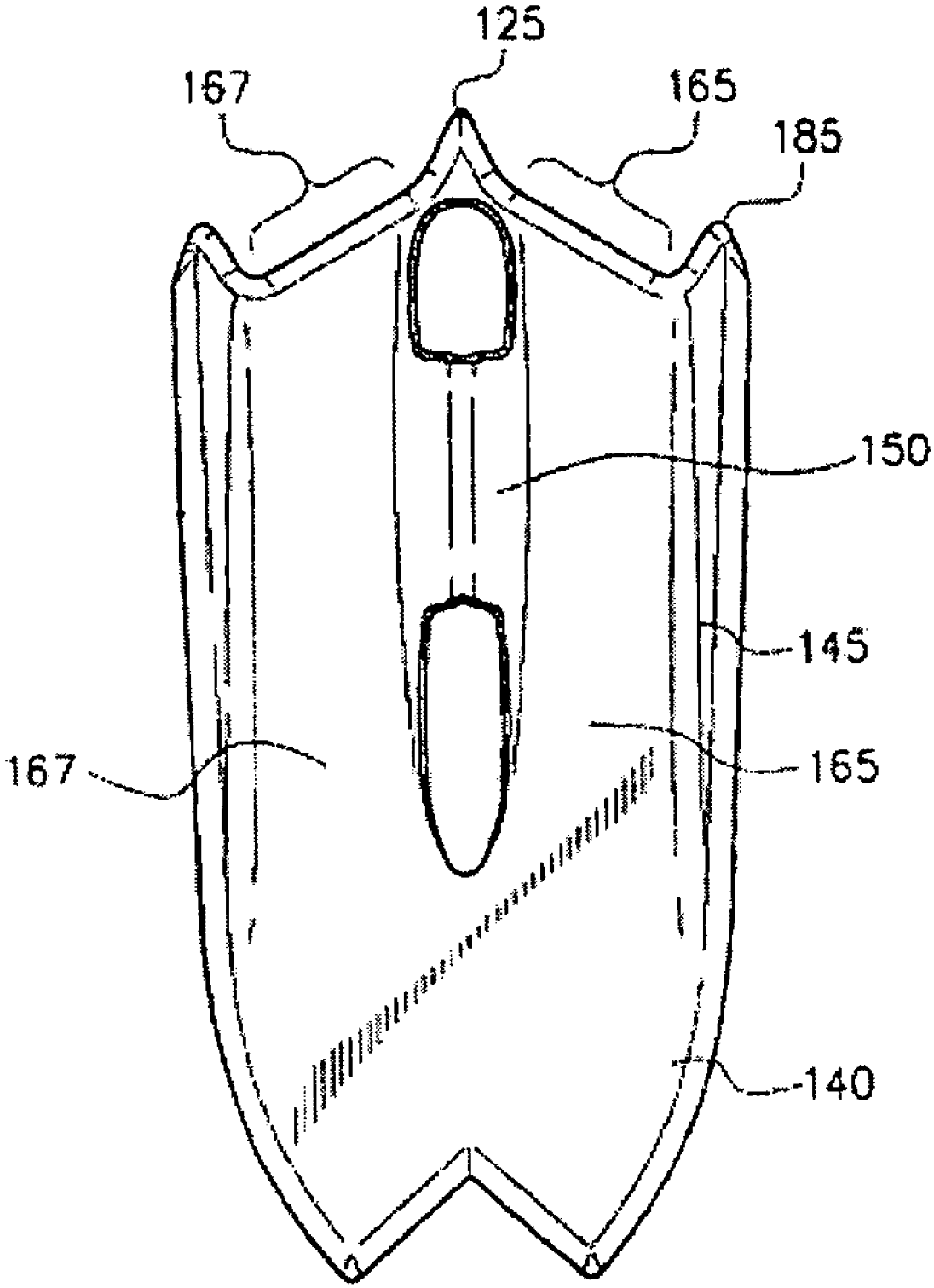
FIG. 2 illustrates a bottom view of an embodiment of the apparatus.

One embodiment of the sports board 100 can be arranged as shown in FIG. 1, which is a buoyant riding apparatus comprising a top surface 110 that is configured to support a rider. The rider can range from a small child to a full-grown adult with a weight ranging from 30 to 300 lbs, and where the top surface 110 is appropriately sized to support the majority of the torso of a rider. The sports board 100 has a top surface 110 has a front portion 120 and a rear portion 130 that can be two feet wide by four feet long for the average rider, but may range from 12-48 inches wide and 24-72 inches long. As shown in FIG. 2, the sports board 100 also has a bottom surface 140 with a central protrusion 150 that extends from the front portion 120 to the rear portion 130. The central protrusion 150 may help to stabilize the sports board 100 in the water. The central protrusion 150 can extend from the bottom surface 140 the same distance from the front portion 120 to the rear portion 130 or it can be tapered so that the protrusion has a greater height or keel depth point 155 above the bottom surface 140 at the front portion 120 than the rear portion 130. The central protrusion 150 forms the bottom surface into a V-shaped hull as displayed in FIG. 3 thereby increasing stability when crossing perpendicular or offset to waves fronts.

The sports board 100 may have a compartment 160 in the top surface 110 configured to accept personal articles as shown in FIG. 1. A personal article can be such items as wallets, keys, eyeglasses, change, identification, parking stubs or any other item that would fit within a compartment that was 3-10 inches deep with an opening 3-34 inches long by 3-25 inches wide. A watertight cover 170 may be removably secured to the compartment 160 to prevent damage and loss of personal articles while using the sports board 100 in the water. This prevents theft or loss of personal articles by preventing them from being left onshore as typically required during use of a board without a compartment. A rigid ring 165 may surround the perimeter of the compartment 160 to ensure that there is minimized flexing of the compartment 160 and maintain the water tightness of the cover 170 protecting personal articles from loss. A gasket or seal may be used in conjunction with the rigid ring 165 to further assist in preventing water entry into the compartment 160.

The sports board 100 may be divided into sections of the top board 110 and bottom board 140. These sections may be separated in order to allow for easier manufacturability and also to allow for different densities of foam to be utilized where needed as shown in FIG. 4. For durability, a heavier or more rigid foam might be used on the bottom, whereas a lighter and more resilient foam might be used on the top. This lighter foam of the top section 110 may be chosen solely for customer comfort by allowing substantial compression of 10 to 50% of the thickness of the top section 110. The lower board portion 140 may be affixed to the upper section of the board 110 using an adhesive or a mechanical fastener. The waterproof compartment 160 access is through the top board section 110 that is normally facing upwards.

The sports board 100 can have a first edge 180 terminated by a first grip projection 185 in the front portion 120 and a second edge 190 terminated by a second grip projection 195 in the front portion. The grip projections 185, 195 are positioned to easily maintain the rider's torso on the top surface of the body of the board. Grip projections 185, 195 at the front portion 120 also may allow the sports board 100 to be steered in the desired direction that may not be possible with grips positioned on the sides. For stability purposes the sports board 100 may provide a first protrusion 135 and a second protrusion 137 in the rear portion 130 of the top surface 110. For added stability a central projection 125 may be positioned on the top surface 110 positioned between the first and second grip projections 185, 195. The sports board 100 when configured as a body board has a top surface 110 that may have a length greater than 3 feet and a width greater than 1.5 feet and when configured as a surf board can have a top surface 110 that has a length greater than 5 feet and a width greater than 1.5 feet.

In another embodiment the sports board 100 can be modified into a motorized buoyant sports apparatus by adding a propulsion source 200 into the lower body section chamber 205 of the sports board 100. The propulsion source 200 can be attached to the body 205 by being embedded into the lower surface 140 as shown in FIGS. 3 and 4 near the midpoint of the board. A controller 230 is positioned on the board for the rider to control the speed of the sports board 100 in the water. A power source 240 is connected to the propulsion source 200. The power source 240

Figure 13:
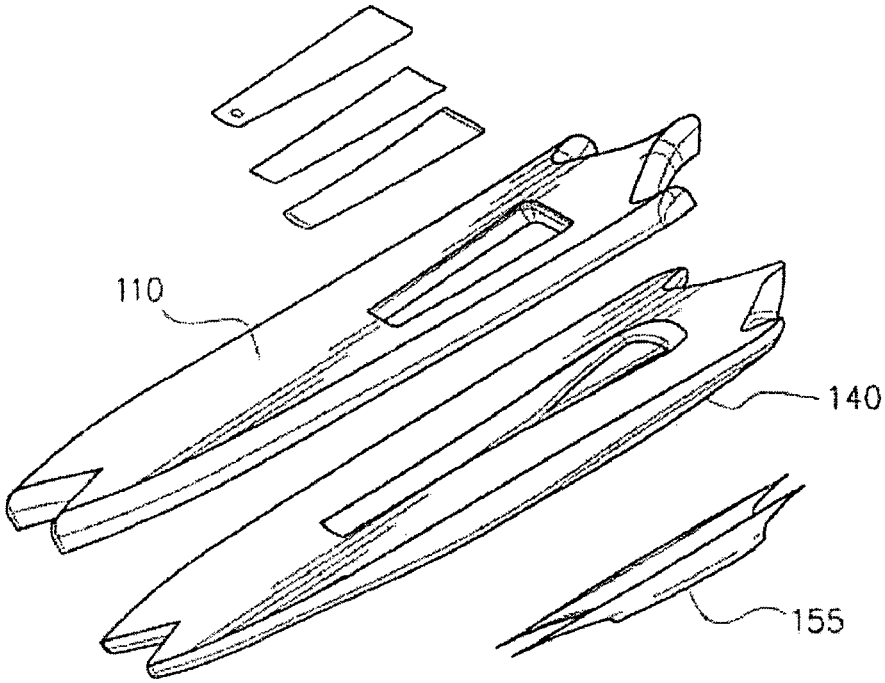
FIG. 13 illustrates a side exploded view of an embodiment of the apparatus.
Figure 14:
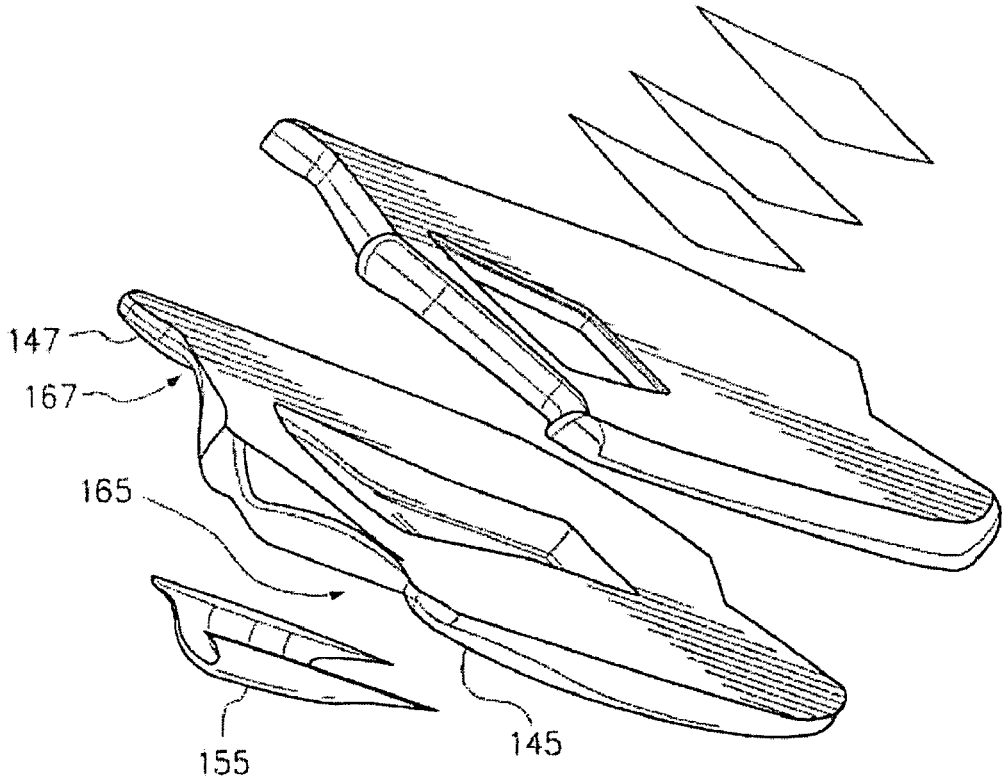
FIG. 14 illustrates a side exploded view of an embodiment of the apparatus.

In another embodiment of the motorized buoyant sports apparatus 100 may comprise a body with a triple V-hull design shown in FIG. 3. The central protrusion 150 of the triple V-hull may be larger in size than the non-motorized embodiments herein to house the propulsion source 200 on the bottom of the board section 140 or even a separate part as shown in FIG. 13. The top surface 110 is configured to support a rider, wherein the top surface 110 has a front portion 120 and a rear portion 130. A first edge 180 may be terminated by a first grip projection 185 and a second edge 190 is terminated by a second grip projection 195 in the front portion 130. A first triangular shaped protrusion 135 and a second triangle shaped protrusion 137 are located in the rear portion 130 of the top surface 110. There can be a central triangular projection 125 on the top surface 110 positioned between the first and the second grip projection 185, 195 to aid in traveling through waves with greater stability.

The triple V-hull design can include a bottom surface 140 having a central protrusion 150 that may extend from the front portion 120 to the rear portion 130. To increase stability the board may further include a first outrigger edge 145 and a second outrigger edge 147 are defined by the bottom surface 140. As displayed in FIG. 3 a first channel 165 may be formed between the first outrigger edge 145 and the central protrusion 150 and a second channel 167 may be formed between the second outrigger edge 147 and the central protrusion 150.

The channels 165, 167 allows water to pass with reduced or minimal drag and the outriggers edges 145, 147 aid in lateral stability.

Figure 5:
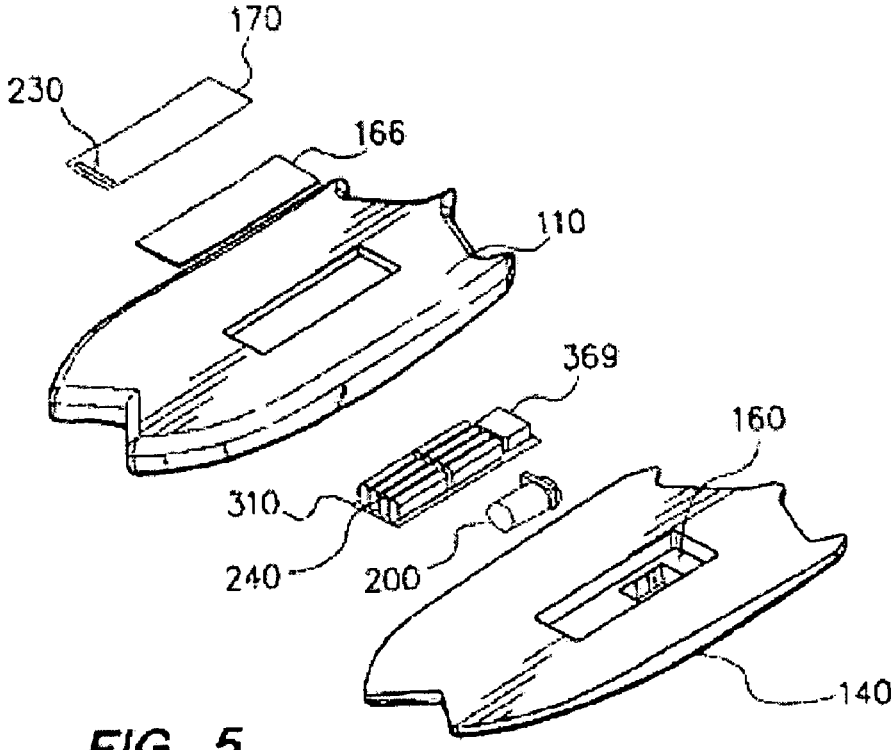
FIG. 5 illustrates a top perspective exploded view of an embodiment of the apparatus.
Figure 17:
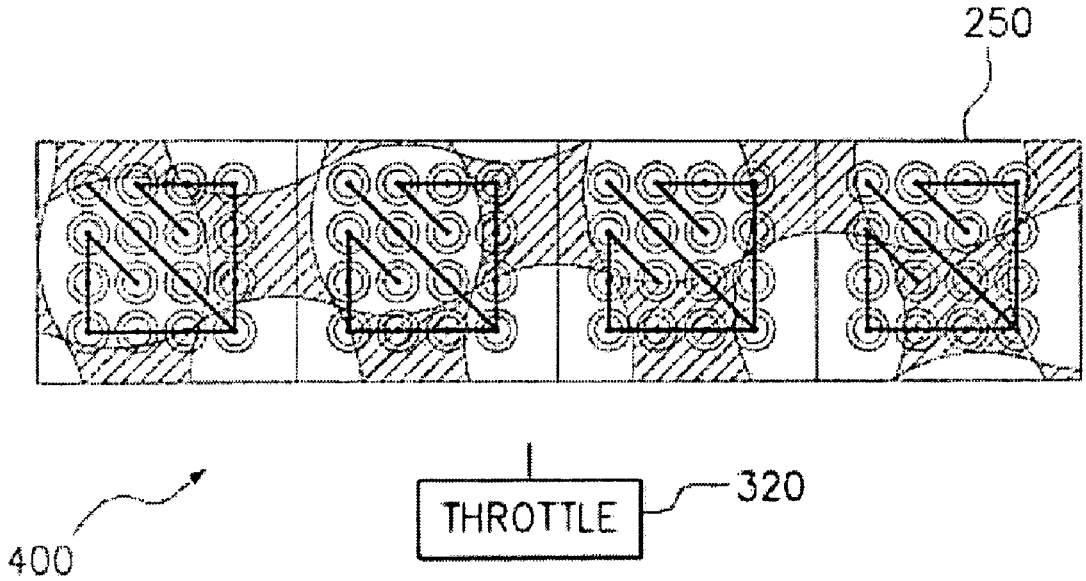
FIG. 17 shows a touch pad of an embodiment of the apparatus.

A frame 310 may be attached to the bottom surface 140 or embedded within the body as shown in FIG. 4, wherein the propulsion source 200 is releasably attached to the frame 310. The compartment 160 in the top surface 110 can be configured to accept personal articles and also allow access to the propulsion source 200 that can be positioned directly beneath as shown in FIG. 5. The watertight cover 170 may be used to prevent water damage to portions of the propulsion system 200 and the loss of personal articles. A touch pad 250 for rider interface, as shown in FIG. 17, can be placed anywhere on the top surface 110 and be arranged so that it is connected to the throttle 320 of the propulsion source 200. The propulsion system 200 as shown in FIG. 12 may comprise an in-line water pump that may be powered by an electric motor or geared indirectly using gear reduction 201 and powered by a combustion motor 369.

Figure 12:
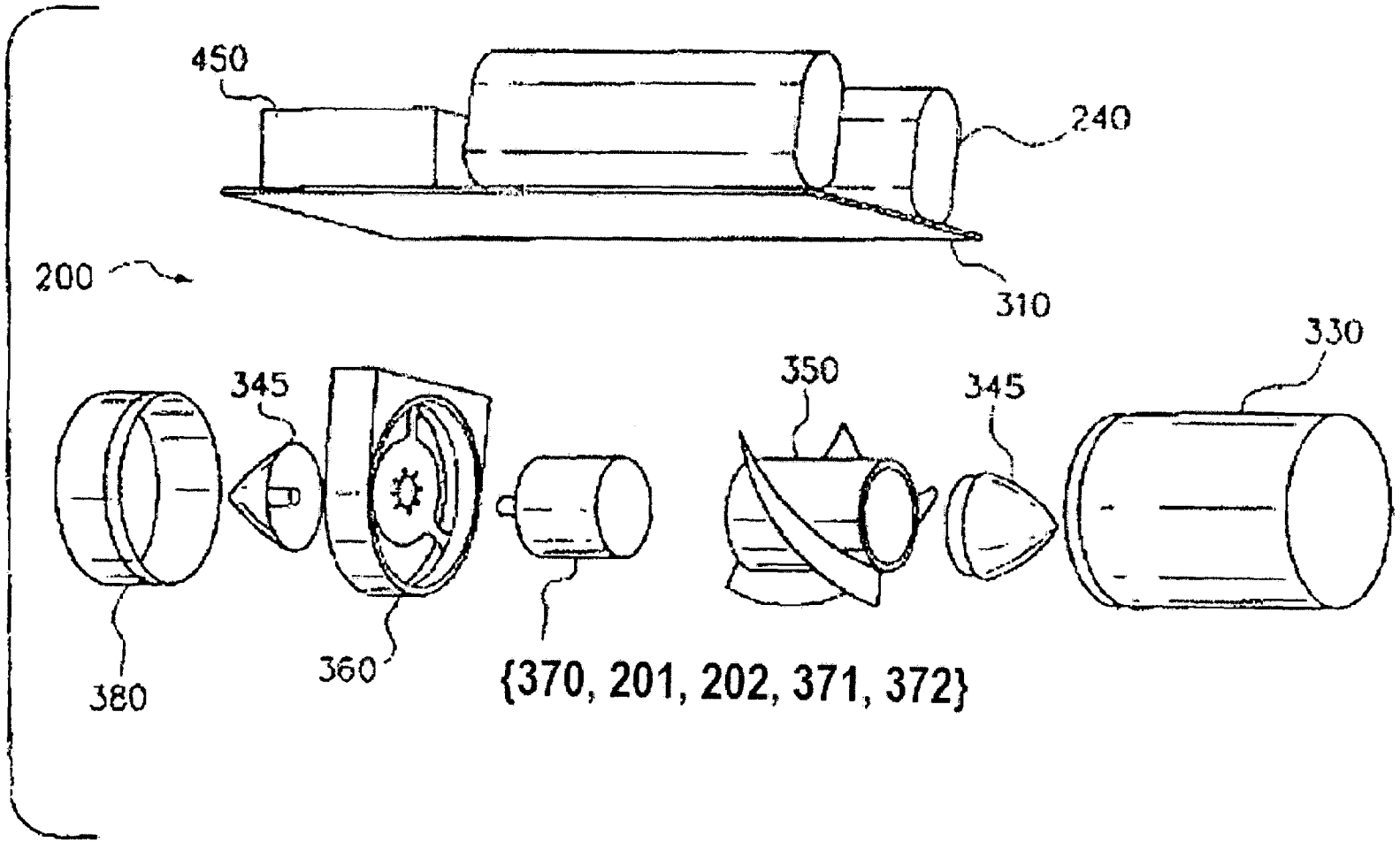
FIG. 12 shows an exploded view of an embodiment of the propulsion source of the apparatus.
Figure 12A:
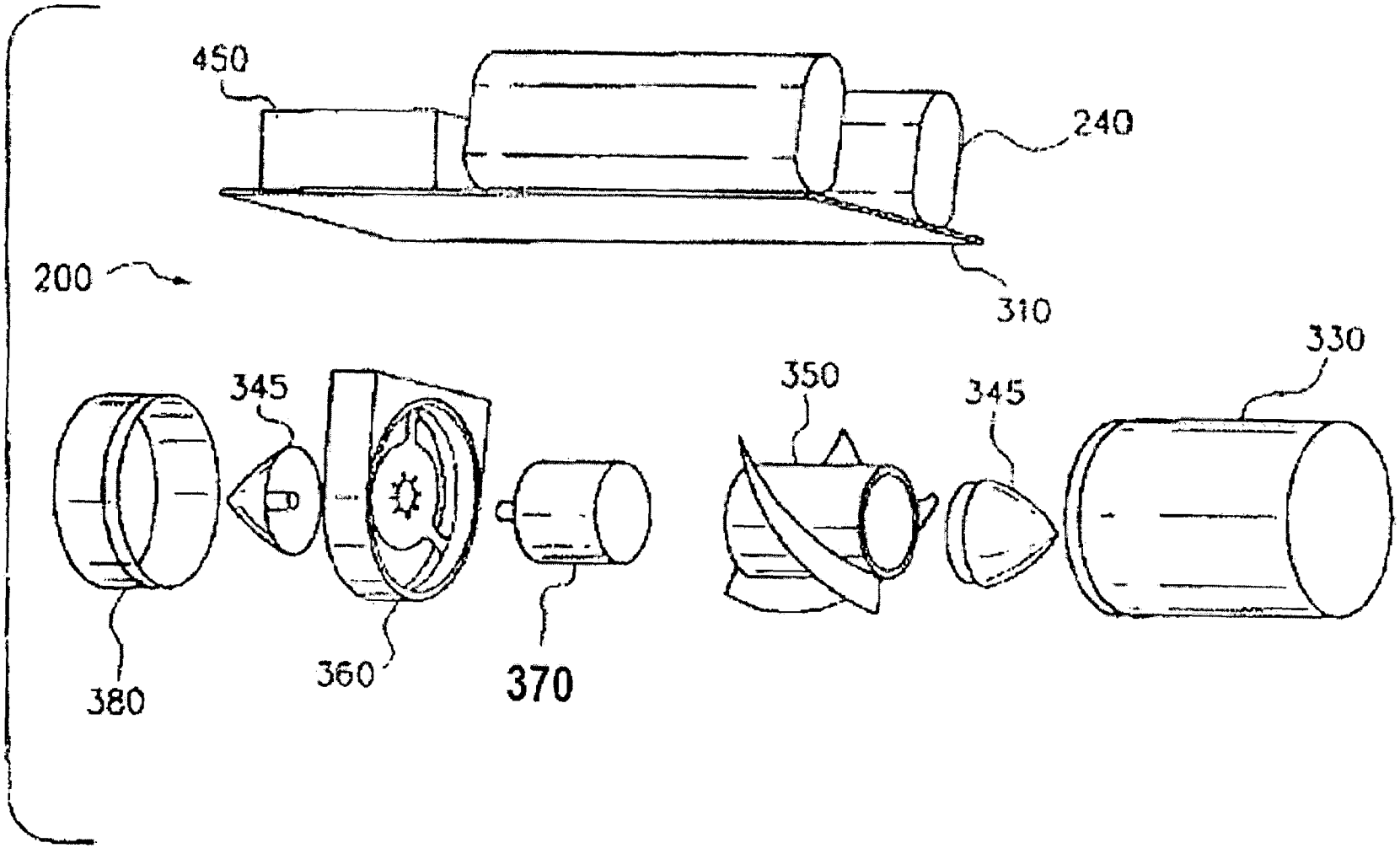
Figure 12B:
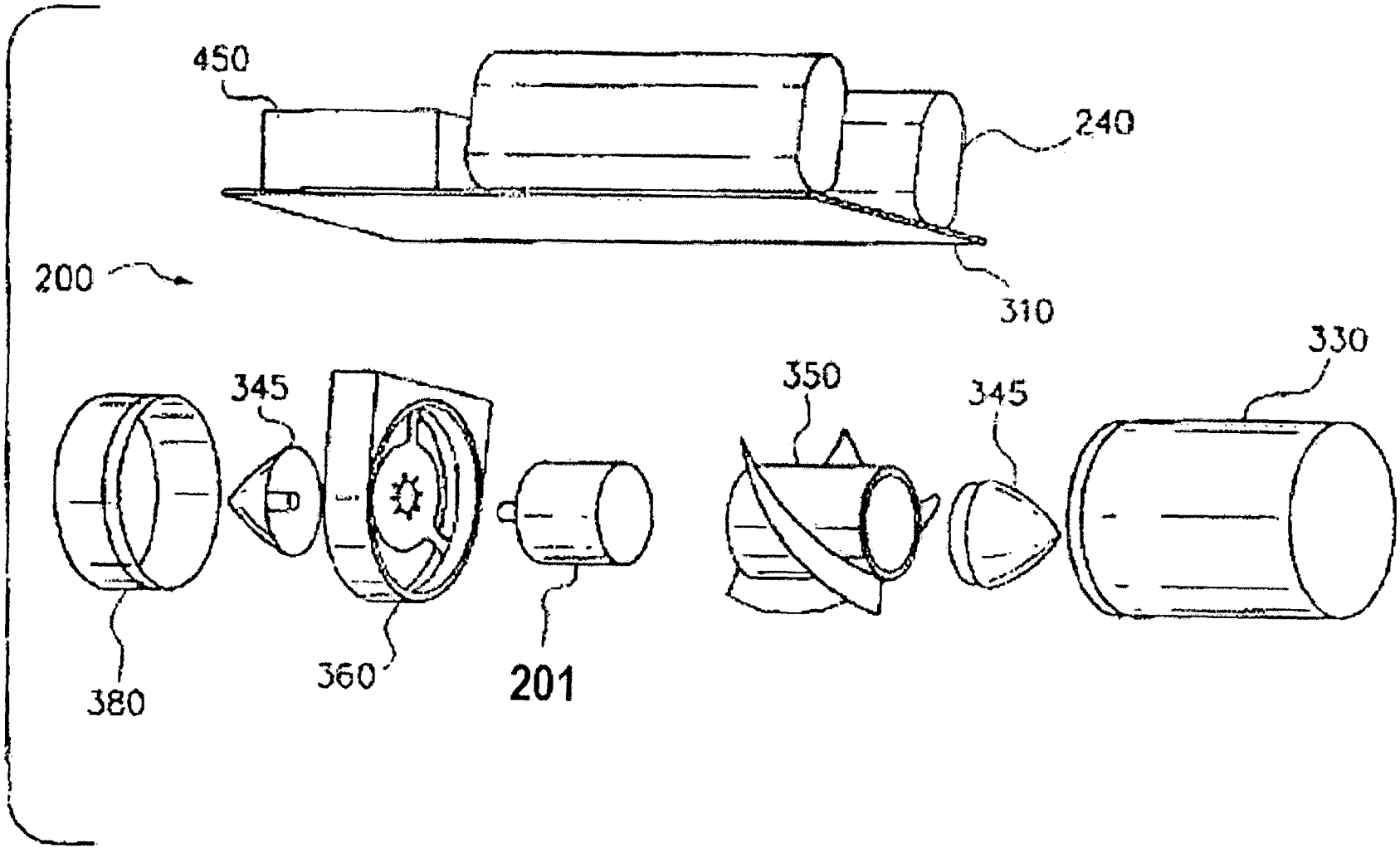
Figure 12C:
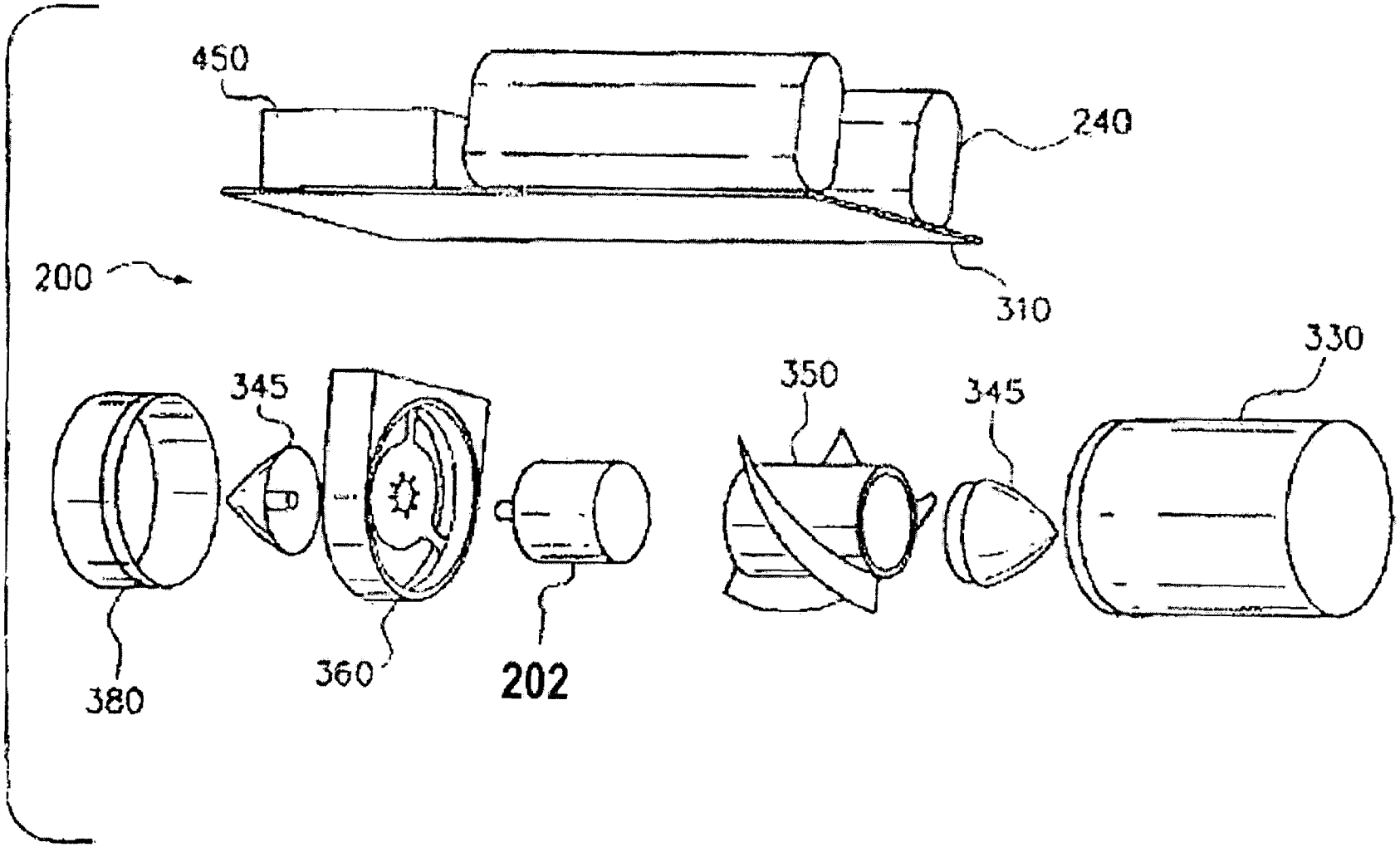
Figure 12D:
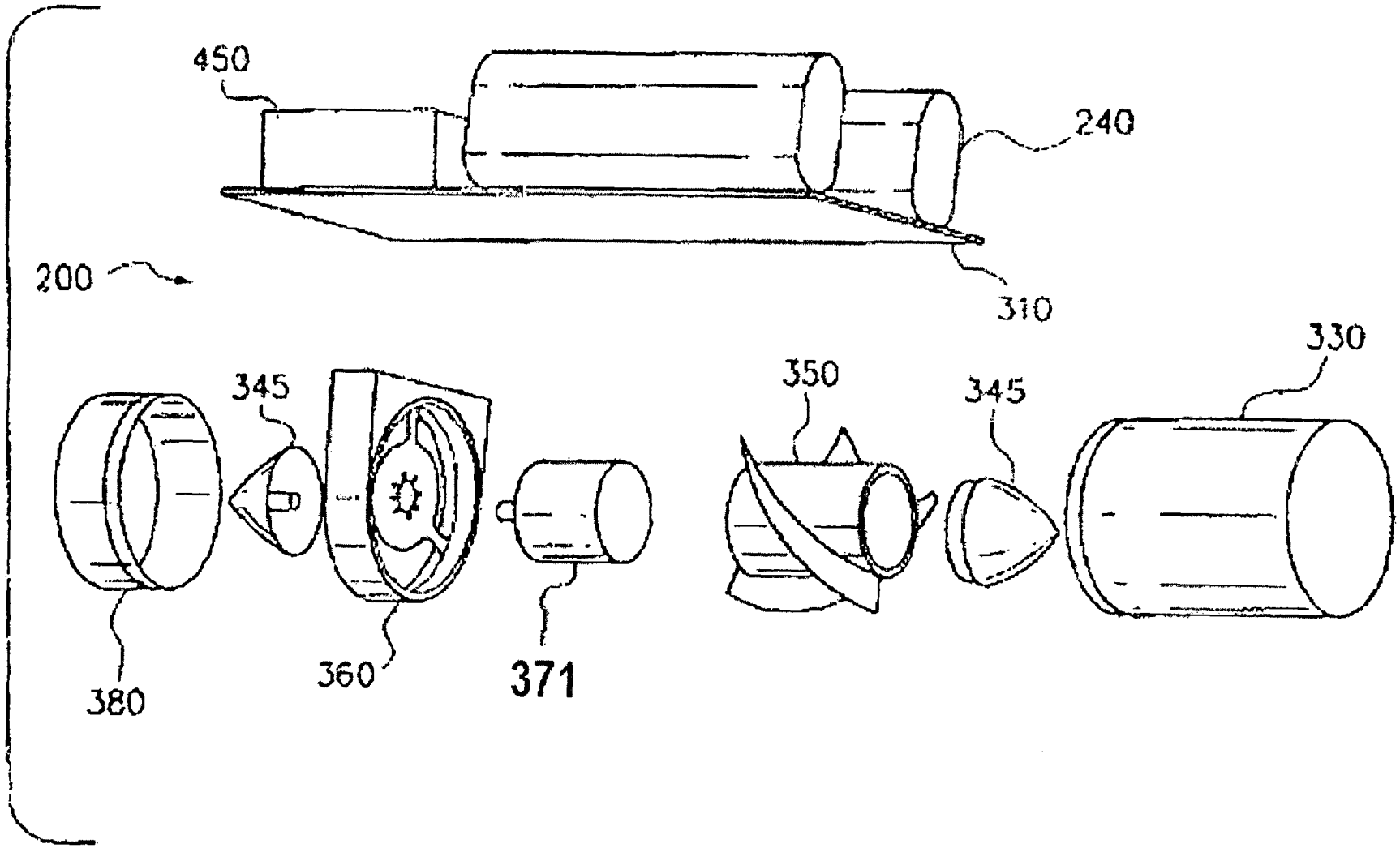
Figure 12E:
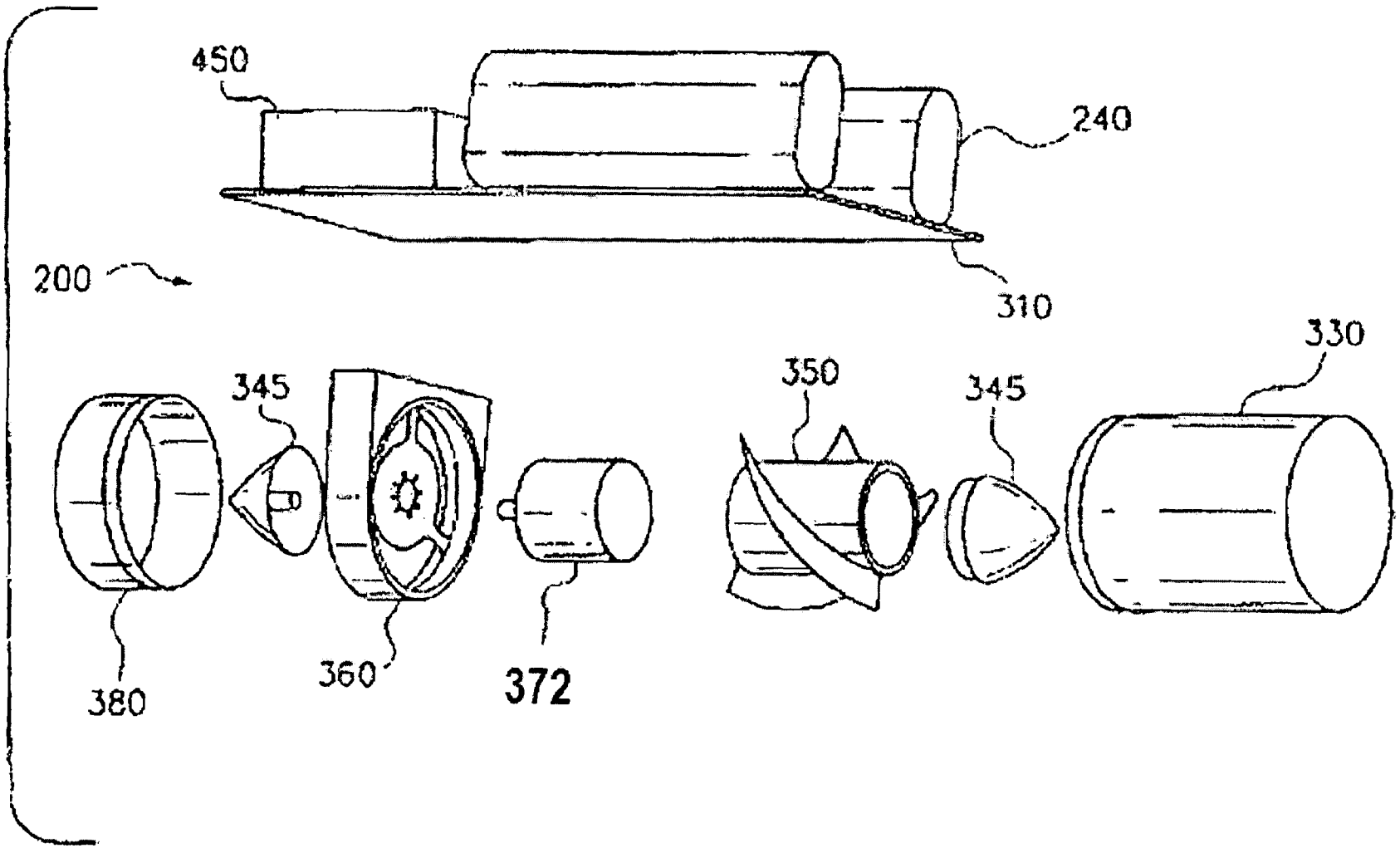

One example of an exploded view of a propulsion system 200 is provided in FIG. 12 where the frame 310 that is embedded into the body of the sports apparatus 100 is attached to the propulsion components 200. A first port 330, when moving forward it acts as an inlet, than can also be used to act as a pump cover and may be secured with a fastener 315 to a coupler 360 that surrounds the frame 310. A rotational source 370 may be secured to a second coupler 365 having a shaft that engages the pump 350. A second port 380, when the sports apparatus is moving forward it acts as an outlet, can also act as a cover for the propulsion source 370. The propulsion source 370 can be either be directly attached to the pump 350 or provide rotation of the pump 350 through gearing 201 or pulleys 202. Components 201, 202, 371, 372, which are conventional and are known in the art, are interchangeable and/or connectable with 370: gearing 201 fits inside of pump 350; pulleys 202 fits inside of pump 350; transmission 371 fits inside of pump 350; geared or chain-driven mechanism 372 fits inside of pump 350. A direct propulsion source 370, either with an electric motor or motor spun by release of compressed gas is the most efficiently packaged. The indirect source of rotation may be geared or chain driven mechanism 372 that allows placement of an engine 373 within the compartment 160 out of the water during use. The use of a conventional combustion engine allows for the benefit of immediate refueling without recharging of batteries or storage tanks. Either propulsion source 370 may be used with the sports board 100 as both have inherent advantages and disadvantages with the use of either system and the end user may prefer one system over another because of a specific benefit that is granted greater importance.

Figure 11:
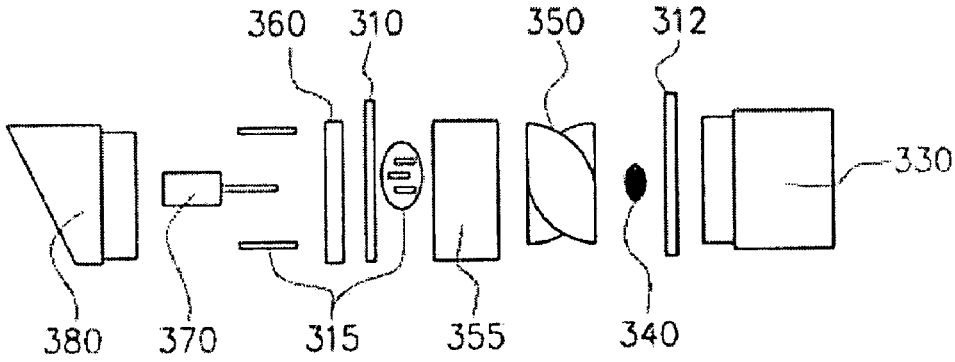
FIG. 11 shows an exploded view of an embodiment of the propulsion source of the apparatus.

The propulsion source 370, as shown in FIG. 11, can also be arranged to mount upon two frames 310, 312 with only one coupler 360 required and having a pump cover 355 over the pump 350. A drivedog 340 may be used to secure the propulsion source to the impeller 350. The propulsion source 370, as discussed above, can be either direct or indirect source of rotational motion to the pump 350. When the propulsion source 370 is indirect it is either a gear or chain driven shaft that provides rotation to the pump 350 from an offset motor. The motor may be offset if it is a combustion motor and it may be positioned within the body or within the water tight compartment 160 to prevent water entry. A direct motor 370 can be an electric motor or a motor spun by for example compressed gasses that may not require combustion and lubrication for sustained operation.

In one embodiment as shown in FIG. 12, the propulsion source 370 is an out runner brushless DC motor (BLDC) that can be inserted into an impeller 350, which becomes part of the pump 350 that drives the sports apparatus 100 through the water. The shaft is attached to the motor and the pump blade is attached to the shaft. The pump blade may be secured to the shaft by use of a drive dog that holds the pump blade in place or any other method of securing. The BLDC motor 370 can be built into the impeller 350 to increase efficiency and reduce complexity. The central impeller case can be used as the BLDC motor can. (Impeller+BLDC outrunner motor)=(Impeller motor). This may allow one to greatly increase the number of windings within the BLDC motor, and other benefits, while not increasing the size of the pump, and reducing the pump part count. The spinner(s) 345 can be placed within the first port 330 and second port 380 and can be made of sacrificial less-noble metal, for example zinc, so as to protect the remaining pump assembly 200 from corrosion. The electric motor 370 sits in the water and therefore is maintained cool by the flow of water. The electric motor 370 can be brushed, brushless, and can be either geared or non-geared. The power source of the electric motor 370 may be a rechargeable battery, fuel cell or any other electrical emitting device embedded into the body.

When the propulsion system 370 is powered by a combustion engine it may be housed within the compartment 160 to prevent water entry into the engine. The engine may be fueled by a combustible material such as gasoline, diesel, kerosene, propane, natural gas or others, which may be stored within the body of the sports apparatus 100 in a refillable tank and the air for combustion may be drawn from the compartment 160. The engine may be geared 201 and attached to a transmission 371 to vary the speed of the impeller 350 in relation to the rpm of the motor.

Figure 15A:
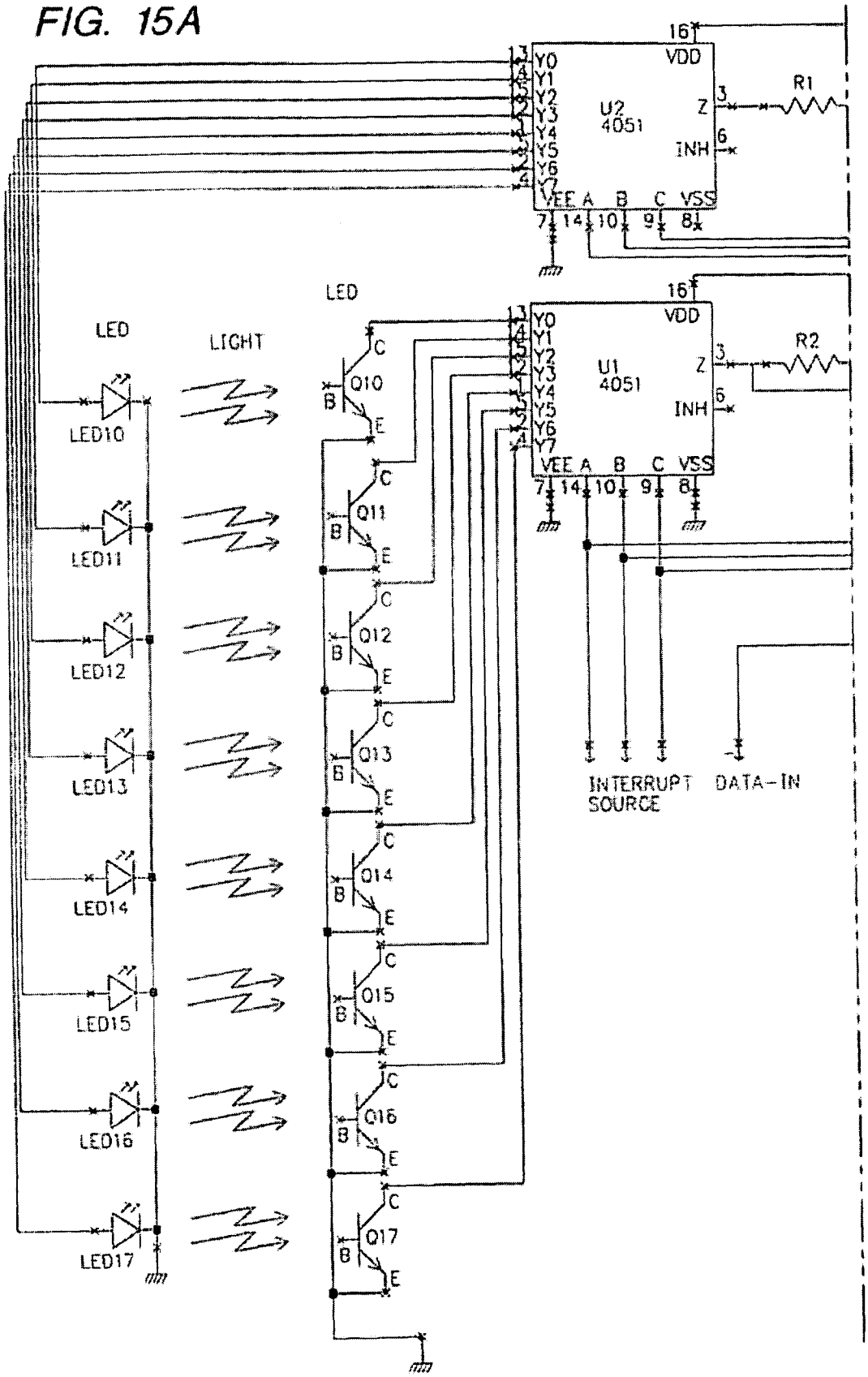
FIG. 15 shows a circuit of an embodiment of the apparatus.
Figures 15, 15B:
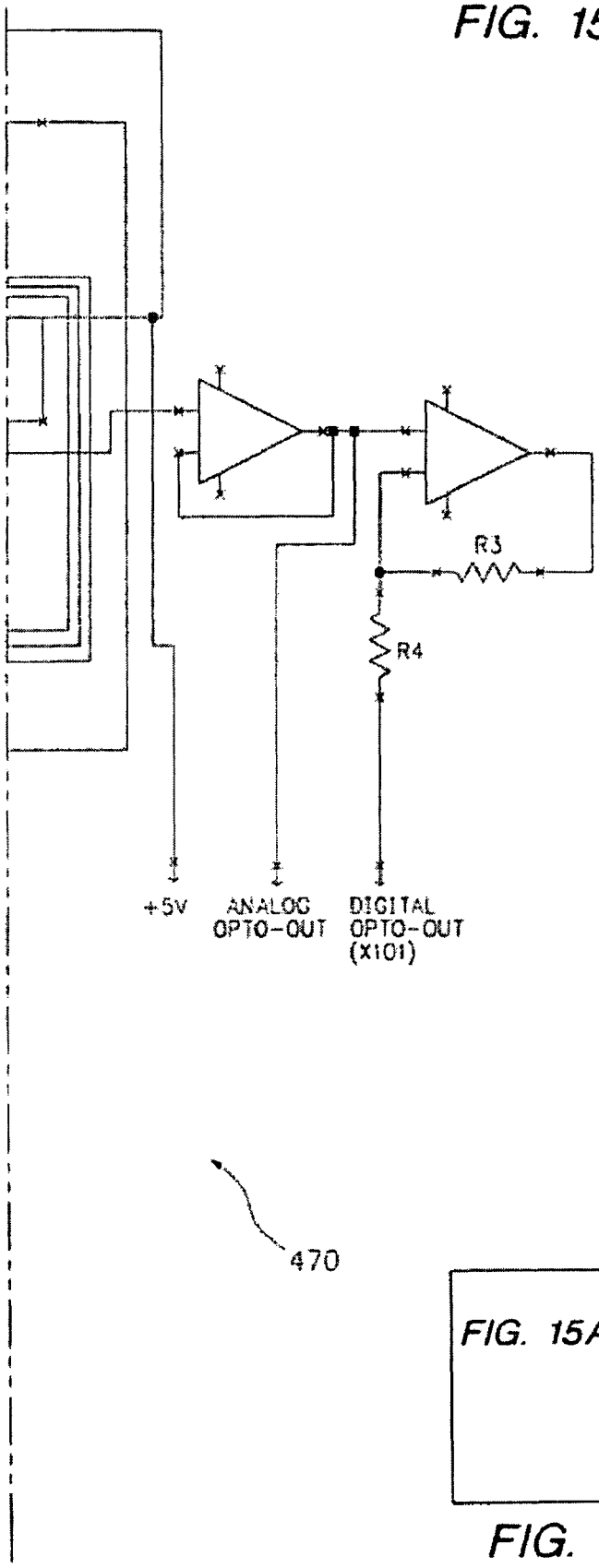
Figure 16A:
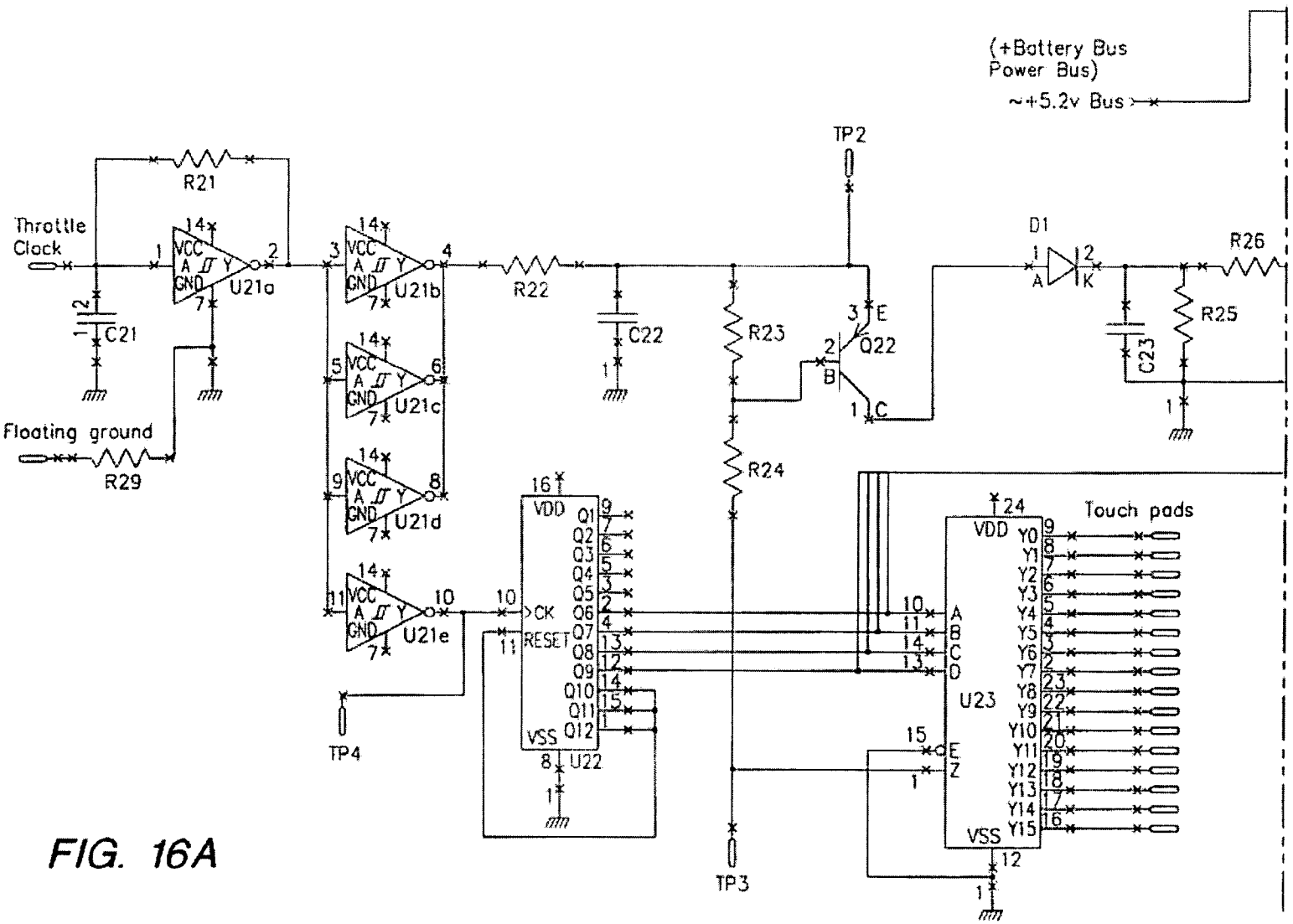
FIG. 16 shows a circuit diagram of an embodiment of the apparatus.
Figure 16:
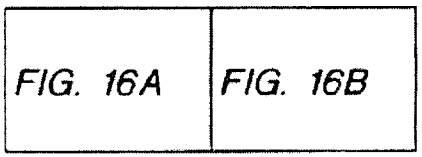
Figure 16B:
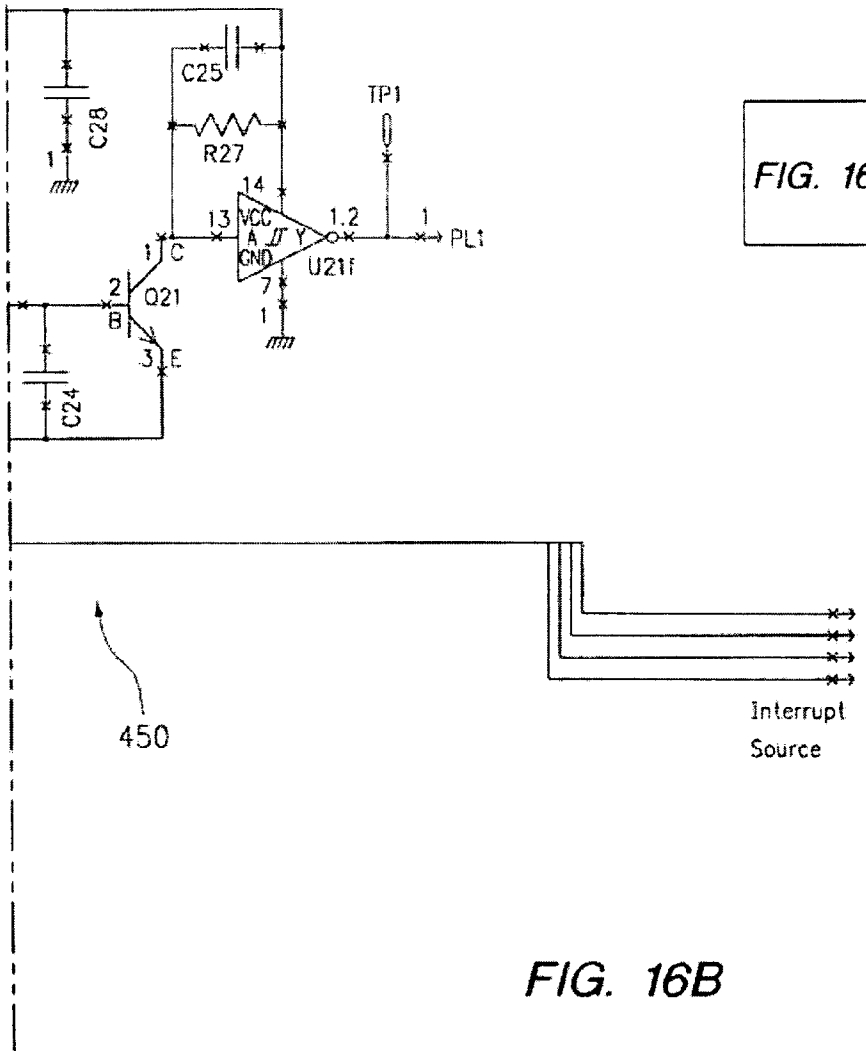

The sports apparatus 100 may include a touch capacitance circuit 400 as shown in FIG. 17 that are round pads surrounded by a copper pour. The sports apparatus 100 may also include an integrated controller mux 450 is used to poll each touch pad 250. The apparatus may also further comprise a clock source 470 to drive the capacitance circuit and the mux clock as shown in FIG. 16, wherein the touch capacitance circuit forms an input to the integrated controller 470 that outputs a control signal as shown in FIG. 15 to drive the propulsion source 370 that may be a brushless DC motor controller attached to a DC motor 370 that spins an impeller 350. The electronic components may be housed in the compartment 160 to prevent water entry in addition to being waterproofed with coating such as typical with automotive electronics exposed to the environment.

The sports apparatus 100 may also comprise a unique throttle system human-interface device. A touch capacitance circuit 400 with an integrated circuit counter-controlled Mux 470 that is used to poll each touch pad as shown in FIG. 16. The throttle circuitry may be tunable with a potentiometer, and the system can be designed to utilize the capacitance of a human body or thumb to control the speed of the sports board 100 through the water. The touch pad 400 may be created to be easily replaceable and be created on flex PCB that may attach to the sports board via an adhesive on the back side or a simple mechanical interlock such as Velcro type hooks and loops.

The Sports board 100 may be one of several types of throttle systems to control the speed of the motor, which can be of mechanical or electronic circuitry, and be configured to withstand the effects of both fresh water and salt water. The throttle when made of an electronic circuits may reduce the risk of water entering into areas of the design that were critical to keep relatively water free and also may be more efficient in packaging. The electronic throttle may include a Human-capacitance (aka "Touch circuit") and that by incorporating an ignoble sacrificial metal (zinc,) the environmental decay of the circuitry and also the metal parts, both internal and external, of the sport board 100 and the metal parts of the exposed throttle circuitry can be reduced.

Throttle design circuitry described and shown by the diagram in FIGS. 15 and 16 may be configured to have a main clock that is split into two different clocks: The HCLOCK which is an a/c-like clock which is used to help identify human capacitance. The HCLOCK is present at test-point TP2, and the MUXCLOCK, which is present at TP4, which drives the CMOS 4040 ripple counter. As the ripple counter is driven by the MUXCLOCK, the Q digital outputs correspond to the count of clock transitions received at the CK pin since the last reset. Outputs Q6, Q7, Q8 and Q9 are wired to the CMOS 4067 Mux IC's A, B, C, D address pins. The CMOS 4040 IC can be wired in such a manner, so that on a set number of clock transitions, a different touch pad will be used to scan for human capacitance change: a single touch-pad pin is selected by the Mux A, B, C, D address pins, and the corresponding touch pad pin can be muxed to the Human Capacitance circuit.

The circuit can have a specific dwell time on each touch pad 250 of a number of clock cycles, so as to help eliminate both false positives and false negatives. Thus, each time the human capacitance is detected, an interrupt signal may be generated and the cause of the interrupt (the touch-pad address causing the interrupt) may be present on the CMOS 4067 Mux A, B, C, D lines. Thus it is possible to know the source of the cause of the interrupt. These MUX A, B, C, D lines may be monitored by a microcontroller to ascertain the desired throttle setting. Since the touch pads 250 are spaced closely together, it is possible and indeed likely, that several touchpad regions will register as being active at any given time. This information may be processed in such a manner so that the average throttle setting can be sensed by the microcontroller, where software will be utilized to average and trend the received inputs. When the CMOS ripple counter passes the count of 1023, the signal on Q10 will go high. Since Q10 is attached to the RESET pin of the CMOS 4040 IC, this will cause the IC to be reset, and the count will be reset to zero, and the polling of the touch pads will begin again at the first touch pad and cycle through all the touch pads until the ripple counter IC is reset again.

Figure 6:
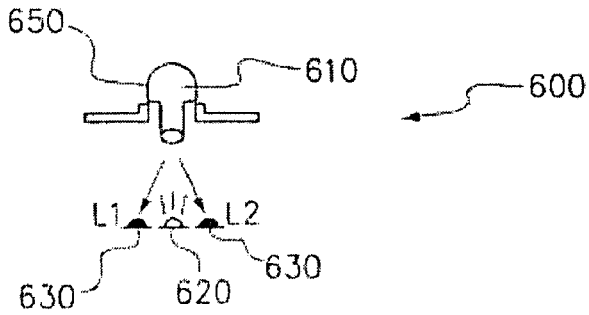
FIG. 6 illustrates an embodiment of the apparatus using an LED to control the throttle.
Figure 7:
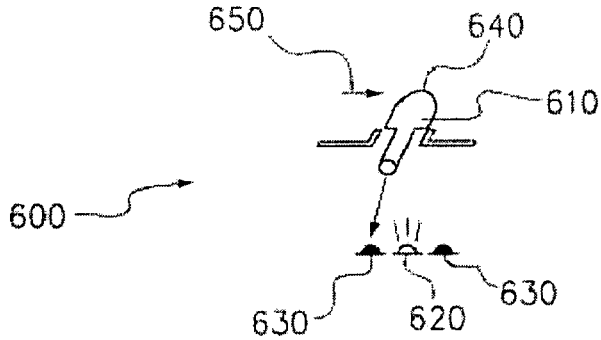
FIG. 7 illustrates another embodiment of the apparatus using an LED to control the throttle.
Figure 8:
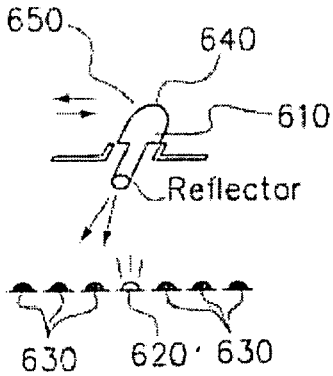
FIG. 8 illustrates another embodiment of the apparatus using an LED to control the throttle.

Another embodiment of the throttle control is shown in FIGS. 6 and 7, which is a LED-based throttle circuit 600 that may have better corrosion resistance than the Human-capacitence circuit. The LED-based throttle circuit 600 utilizes a condition where light or emitter 620 is reflected onto a LED will generate a small voltage. To fabricate the LED Throttle device 600, room-temperature-vulcanizing (RTV) rubber may be poured over a reverse mold of the desired throttle input device shape. After the RTV cures, the part is removed from the mold, The reflectors 630 are added, and finally the completed assembly is placed over the Throttle Circuit board 600. The throttle assembly 600 may be sealed to ensure more protection from the elements. The Throttle Circuit board may contain LEDs 620, 630 configured in a manner so as be able to sense the default positions 640 of the RTV Post 610 and the activated positions 650 of the RTV Post 610. The throttle assembly can be made up of any number of RTV Throttle posts 610. The diagram of FIG. 8 shows details of one post, but several posts can be positioned close together.

Figure 9:
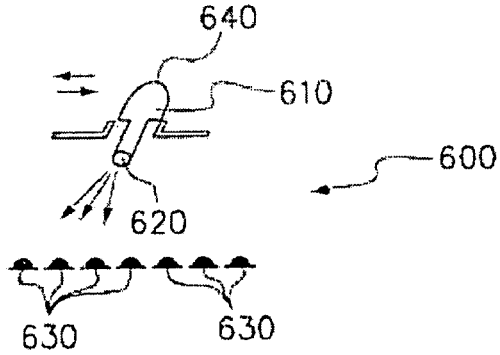
FIG. 9 illustrates another embodiment of the apparatus using an LED to control the throttle.

When the RTV POSTS 610 are in their activated positions 650, voltage levels at the receiver LEDs 630 will differ, dependant upon the reflector angle to the receiver LEDs 630. The greater the angle of the light, the less reflected light will be picked-up at the receiver LEDs 630 and converted to voltage. This voltage can be amplified, and then measured with an Analog-to-digital converter circuit. Several alternate configurations are shown of the LED circuit 600. Another possible embodiment as displayed in FIG. 8 may show a possible configuration that may allow more easily for forward and reverse throttle input to be identified by having a central LED emitter 620 surrounded by LED receivers 630. A still further embodiment of FIG. 9 shows the Emitter LED 620 placed into the RTV Post 610 so that a reflector is not needed. In the diagram below, the emitter is shown emitting light that is reflected off of the reflector 660 and detected or measured at two receiver LEDs 630 as is shown. Any number or combination of LEDs can be configured to ensure finer throttle control. In the diagram below, an LED 620 is shown emitting light which hits a reflector 660 and is picked-up by one or more receiver LEDs 630. When the angle of the REFLECTOR 660 is changed, less light is directed towards the receiver LEDs 630 shown. The voltage levels at each receiver LED 630 can be measured, so as to assuage the relative angle used to pick-up reflected light.

Figure 10:
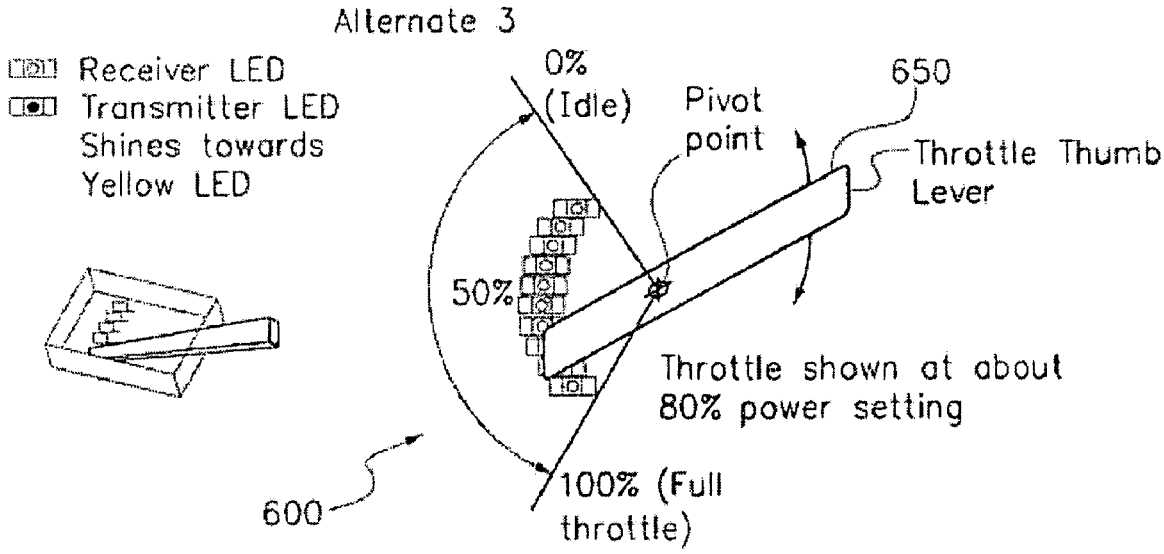
FIG. 10 illustrates another embodiment of the apparatus using an LED to control the throttle.

A still further LED embodiment is displayed in FIG. 10 wherein the transmitter LED is contained in the base of the thumb lever post 610 and multiple receiver LED 630 that corresponds to a percentage of full throttle when light is received. This embodiment shows the use of an RTV box and built-in RTV Throttle Thumb Lever that controls the maximum angle the Lever can travel which is the arc which comprises the receiver LEDs as shown. In this embodiment, the red LED or transmitter LED is understood to be pointing down, towards the yellow LEDs, which are the receiver LED. The configuration of the LEDs is claimed and any number of LEDs can be configured to ensure finer throttle control. In FIG. 10, an LED is shown emitting light which hits a reflector and is picked-up by one or more receiver LEDs. When the angle of the REFLECTOR is changed, less light is directed towards the receiver LEDS shown. The voltage levels at each receiver LED can be measured, so as to assuage the relative angle used to pick-up reflected light. If the RTV Rubber Post is pushed so that the reflector angle is great, then both LEDs L1 and L2 will show little or no voltage. Also, if the RTV Post is slightly pushed, then the voltages at L1 and L2 will show little deviations. So calibration after manufacture may be required.

Infrared Emitter/Receiver Throttle Circuit may be placed within the Sports Board, either being embedded into the foam of the board and covered with a translucent layer or coating and set into the board. The circuit can utilize two CMOS 4051 circuits that are paired. The INTERRUPT SOURCE indicates which IR Emitter/Receiver pair are in use at any given time. This throttle circuit may be controlled by a microcontroller. In its most simple state, the microcontroller sends a voltage to the IR emitter that transmits a beam of IR light. If a thumb is placed immediately above this emitter, a certain portion of this emitted IR light will be reflected back towards the IR Receiver. The associated phototransistor will detect this reflected IR light and present it at Op-Amp buffer circuit. The output of the buffer circuit can be multiplied by 101, or any other selected multiplier forming an interrupt output that will go high when IR light is detected. It is intended that each IR Emitter/Receiver pair will be stepped through in order to determine the present throttle setting. In order to eliminate false throttle settings, data can be modulated into the DATA-IN pin. This data should also be present at the DIGITAL OPTO-OUT line. For example, if the pattern "0100101001110", or any other pattern, is modulated onto the DATA-IN pin, this same data pattern should be decoded at the DIGITAL OPTO-OUT line, when a finger, toe, ect. Is used as a reflector. Thus it is possible to eliminate false positive throttle commands.

The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

We claim:

1. A motorized buoyant sports apparatus comprising:
a body configured to support a rider comprising:
a top surface configured to support a rider, the top surface having a front portion and a rear portion;
a bottom surface having a central protrusion that extends from the front portion to the rear portion;
a first edge terminated by a first grip projection in the front portion;
a second edge terminated by a second grip projection in the front portion;
a first protrusion in the rear portion of the top surface;
a second protrusion in the rear portion of the top surface;
a central projection on the top surface positioned between the first and second grip projection;
a propulsion source attached to said body;
a controller on said body connected to the propulsion source; and
a power source connected to the propulsion source.

2. The apparatus of claim 1 further comprising:
a frame embedded in said body to support the propulsion source.

3. The apparatus of claim 1 wherein the propulsion source further comprises
an intake for water;
a pump to pressurize water;
a motor attached to the pump; and
an outlet.

4. The apparatus of claim 3 wherein the motor is a brushless DC outrunner motor and the pump is an impeller connected directly to the motor and the power source is a battery.

5. The apparatus of claim 1 wherein the propulsion source further comprises
an intake for water;
a pump to pressurize water;
an engine attached to the pump;
a compartment in the body to encase the engine; and
an outlet to direct thrust of the motor.

6. The apparatus of claim 5 further comprises a gear reduction attached between the engine and the pump, wherein the pump is an impeller.

7. The apparatus of claim 5 wherein the power source of the engine is a combustible material.

8. The apparatus of claim 1 wherein the controller further comprises
a touch capacitance circuit to control a throttle of the motor.

9. The apparatus of claim 8 further comprising:
a zinc coating on the touch capacitance circuit.

10. The apparatus of claim 1 further comprising:
a light emitting diode circuit to control a throttle of the motor.

11. A sports apparatus comprising:
a top surface configured to support a rider, the top surface having a front portion and a rear portion;
a bottom surface having a central protrusion that extends from the front portion to the rear portion;
a first edge terminated by a first grip projection in the front portion;
a second edge terminated by a second grip projection in the front portion;
a first protrusion in the rear portion of the top surface;
a second protrusion in the rear portion of the top surface;
a central projection on the top surface positioned between the first and second grip projection;
a compartment in the top surface configured to accept personal articles; and
a watertight cover to prevent damage and loss of personal articles.

12. The apparatus of claim 11 wherein the top surface has a length greater than 3 feet and a width greater than 1.5 feet.

13. The apparatus of claim 11 further comprising:
a rigid perimeter member surrounding the compartment to accept the watertight cover.

14. The apparatus of claim 11 further comprising:
a propulsion source attached to the bottom surface;
a controller on the top surface connected to the propulsion source; and
a power source connected to the propulsion source.

15. The apparatus of claim 11 further comprising:
a first outrigger edge on the bottom surface; and
a second outrigger edge on the bottom surface.

16. The apparatus of claim 15 further comprising:
a first channel formed between the first outrigger edge and the central protrusion; and
a second channel formed between the second outrigger edge and the central protrusion.

17. A motorized buoyant sports apparatus comprising:
a top surface configured to support a rider, the top surface having a front portion and a rear portion;
a first edge terminated by a first grip projection in the front portion;
a second edge terminated by a second grip projection in the front portion;
a first triangular shaped protrusion in the rear portion of the top surface;
a second triangle shaped protrusion in the rear portion of the top surface;
a central triangular projection on the top surface positioned between the first and the second grip projection;
a bottom surface having a central protrusion that extends from the front portion to the rear portion;
a first outrigger edge on the bottom surface;
a second outrigger edge on the bottom surface;
a first channel formed between the first outrigger edge and the central protrusion;
a second channel formed between the second outrigger edge and the central protrusion;
a propulsion source having a throttle;
a frame attached to the bottom surface, wherein the propulsion source is attached to the frame;
a compartment in the top surface configured to accept personal articles and allow access to the propulsion source;
a watertight cover to prevent damage to propulsion system and loss of personal articles;
an interface connected to the throttle; and
a power source connected to the propulsion source.

18. The apparatus of claim 17 further comprising:
wherein the interface is a touch pad; and
a touch capacitance circuit formed with an integrated controller mux that is used to poll each touch pad.

19. The apparatus of claim 18 further comprising:

a clock source to drive the capacitance circuit and the mux clock.

20. The apparatus of claim 18 wherein the touch capacitance circuit forms an input to the integrated controller that outputs a control signal to drive the propulsion source that is a brushless DC motor controller attached to a DC motor that spins an impeller.

21. The apparatus of claim 17 wherein the interface is a throttle circuit comprises a light emitting diode and a receiver to control throttle position.

22. The apparatus of claim 17 further comprising:

an emitter of infrared light; and an infrared receiver, wherein a portion of the emitted infrared light can be reflected back towards the infrared receiver by a user to control the throttle, wherein the interface is a throttle circuit controlled by a micro controller.

* * * * *